US006037904A

United States Patent [19]

Cheng et al.

[11] Patent Number: 6,037,904

[45] Date of Patent: Mar. 14, 2000

[54] ANTENNA WITH DIFFRACTION GRATING MODULATOR

[76] Inventors: Yuan-Tung Cheng, No. 3, Lane 3, Huang-Pu-San Tsun, Cheng-Yi Li, Feng-Shan City, Kaohsiung Hsien; Chin-An Su, 10F, No. 94, Te-Wei St., Tso-Ying Dist, Kaohsiung City, both of Taiwan

[21] Appl. No.: 09/247,780

[22] Filed: Feb. 9, 1999

[51] Int. Cl.[7] ..... H01Q 1/38

[52] U.S. Cl. ..... 343/700 MS; 343/753; 343/785; 343/909

[58] Field of Search ..... 343/700 MS, 909, 343/785, 753, 754; H01Q 1/38

[56] References Cited

U.S. PATENT DOCUMENTS 4,063,246 12/1977 Greiser ..... 343/700 MS
4,079,382 3/1978 Henry ..... 343/753
5,027,055 6/1991 Lee et al. ..... 324/77 K
5,757,323 5/1998 Spencer ..... 343/700 MS

*Primary Examiner*—Don Wong
*Assistant Examiner*—Hoang Nguyen
*Attorney, Agent, or Firm*—Merchant & Gould P.C.

[57] ABSTRACT

An antenna includes a substrate, a microstrip patch or a slot, a feed line connected to the microstrip patch or slot, and a diffraction grating modulator mounted on the substrate and formed with a spatial periodic structure. The microstrip patch or slot radiates and receives electromagnetic waves when a signal between the substrate and the microstrip patch or slot satisfies resonance conditions. The diffraction grating modulator diffracts the electromagnetic waves in a predetermined manner so as to improve antenna gain and side lobe bandwidth and modulate directionality of the antenna.

19 Claims, 7 Drawing Sheets

ANTENNA WITH DIFFRACTION GRATING MODULATOR

BACKGROUND OF THE INVENTION

1. Field of the Invention

The invention relates to an antenna, more particularly to an antenna that is provided with a diffraction grating modulator to improve antenna gain and side lobe bandwidth and to modulate directionality of the antenna.

2. Description of the Related Art

Antennas are used in the communications field as a system for sending and receiving signals, and are applied for signal reception in household appliances, such as television sets and radios, for signal transmission in pagers and cellular telephones, and in satellite communication systems. With the advent of personal communications, the use of most conventional antennas, such as Yagi-Uda antennas, whip antennas and disk antennas, has become impractical in electronic communication devices in view of the growing trend toward miniaturization of these devices.

Different types of antennas are available in the market. Each type of antenna has its particular characteristics. For example, a conventional Yagi-Uda antenna includes a driven element, a reflector behind the driven element, and one or more directors in front of the driven element. While the lengths of the reflector and the director, and the spacing of each of the reflector and director with the driven element, can be adjusted for optimum directivity and high gain, the Yagi-Uda antenna is too big for use in personal electronic communication devices.

Some of the demands of a modular communications system include lightweight, portability, clear reception, and modular design. By increasing antenna mobility, the design, manufacture and maintenance of the entire communications system can be facilitated. Microstrip antennas and slot antennas are among the few known antennas that can satisfy the above demands to result in a good communications system design.

The microstrip antenna and the slot antenna have a simple construction and can be attached to the surface of any object without affecting the appearance of the latter. Furthermore, these antennas can be formed directly with a circuit component on a monocrystal microwave integrated circuit (MMIC). As such, the microstrip antenna and the slot antenna are widely used in personal mobile communication systems.

Referring to FIG. 1, a conventional microstrip antenna 2 is shown to include a substrate 21 disposed on a ground plane, a microstrip patch 22 disposed on top of the substrate 21, and a signal feed line 24 with a first end connected to the microstrip patch 22 and a second end connected to the ground plane. When a signal between the substrate 21 and the microstrip patch 22 satisfies electromagnetic field resonance conditions, the microstrip patch 22 radiates and receives electromagnetic waves, thereby achieving the object of signal exchange. The radiation pattern of the conventional microstrip antenna 2 is shown in FIG. 2.

While the conventional microstrip antenna 2 offers numerous advantages, it suffers from the drawbacks of a narrow bandwidth of only about 1 to 2 percent, and low antenna gain, thereby seriously limiting the applicability of the microstrip antenna 2. Present efforts at overcoming the aforementioned drawbacks have been aimed at the development of array microstrip antennas.

In addition, the use of frequencies below the Ka frequency band for satellite communications has now become saturated, and there is an urgent need to develop a new frequency band for communications purposes. The Ka frequency band is a higher frequency band in the microwave frequency range, and ranges from 18 GHz to 40 GHz. Aside from being adapted for use in satellite communications, array microstrip antennas usable in the Ka frequency band can also be applied in inter-building data transmission to obviate the need for installing electrical or fiber optic cables. Moreover, because the frequencies that are in use fall within the Ka frequency band, interference with present microwave communication systems can be avoided.

In view of the foregoing, it can be understood that most conventional antennas suffer from one or more of the following drawbacks:

1. A high antenna gain usually involves a bigger antenna size.

2. In a conventional microstrip antenna, the bandwidth is too narrow, and the gain is too small.

3. Once the conventional antenna is mounted, the directionality thereof cannot be modulated.

4. The conventional antenna does not allow for a modular design. As such, a significant adjustment in the operating bandwidth is not possible for a single conventional antenna.

SUMMARY OF THE INVENTION

Therefore, the object of the present invention is to provide an antenna that is capable of overcoming the aforementioned drawbacks that are commonly associated with the prior art.

More specifically, the object of the present invention is to provide an antenna that is provided with a diffraction grating modulator having a spatial periodic structure to diffract electromagnetic waves in a predetermined manner with the aim of improving antenna gain and side lobe bandwidth and modulating directionality of the antenna.

According to one aspect of the invention, an antenna comprises a substrate adapted to be disposed on a ground plane and made of a dielectric material, a microstrip patch disposed on top of the substrate, a signal feed line having a first end connected to the microstrip patch and a second end adapted to be connected to the ground plane, and a diffraction grating modulator mounted on the substrate and formed with a spatial periodic structure. The microstrip patch radiates and receives electromagnetic waves when a signal between the substrate and the microstrip patch and passing through the signal feed line satisfies resonance conditions. The diffraction grating modulator diffracts the electromagnetic waves in a predetermined manner so as to improve antenna gain and side lobe bandwidth and modulate directionality of the antenna.

According to another aspect of the present invention, an antenna comprises a substrate, a slot adapted to be formed in a ground plane, a microstrip feed line adapted to be connected to the ground plane, and a diffraction grating modulator mounted on the substrate and formed with a spatial periodic structure. The slot radiates and receives electromagnetic waves when a signal between the substrate and the slot satisfies resonance conditions. The diffraction grating modulator diffracts the electromagnetic waves in a predetermined manner so as to improve antenna gain and side lobe bandwidth and modulate directionality of the antenna.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 3:
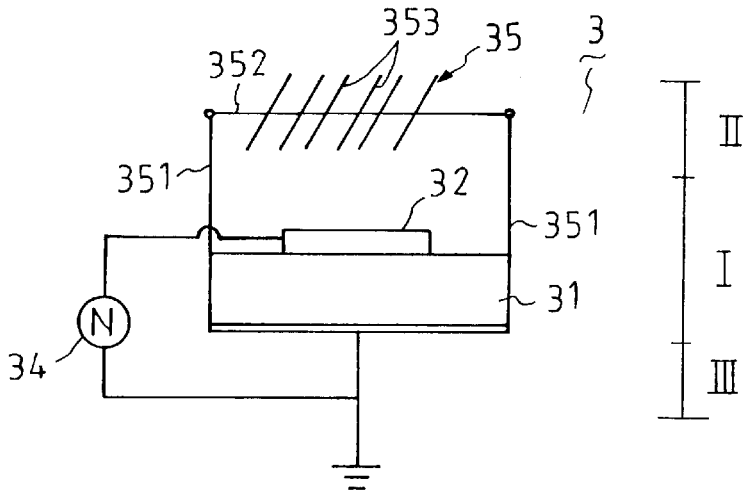
FIG. 3 is a schematic side view of the first preferred embodiment of an antenna according to the present invention.

Referring to FIG. 3, the first preferred embodiment of an antenna 3 according to the present invention is shown to comprise a substrate 31 adapted to be disposed on a ground plane, a microstrip patch 32 disposed on top of the substrate 31, and a signal feed line or probe 34 having a first end connected to the microstrip patch 32 and a second end adapted to be connected to the ground plane. The substrate 31 is made of a uniform dielectric material. A diffraction grating modulator 35 is mounted on the substrate 31, and is disposed on top of the microstrip patch 32. The diffraction grating modulator 35 is formed with a periodic structure. In other words, the diffraction grating modulator 35 has portions that are spaced apart at fixed intervals. In this embodiment, the diffraction grating modulator 35 includes a spaced pair of parallel props 351 that have lower ends mounted on the substrate 31 and that have the microstrip patch 32 disposed therebetween. A control axle 352 extends between and is mounted rotatably on upper ends of the props 351. A plurality of parallel slats 353 are mounted along the control axle 352, and are spaced apart from each other at fixed intervals, thereby providing the diffraction grating modulator 35 with the spatial periodic structure. By operating the control axle 352, the angle that is formed by the slats 353 with a plane that is normal to the substrate 31 can be adjusted.

Figure 4:
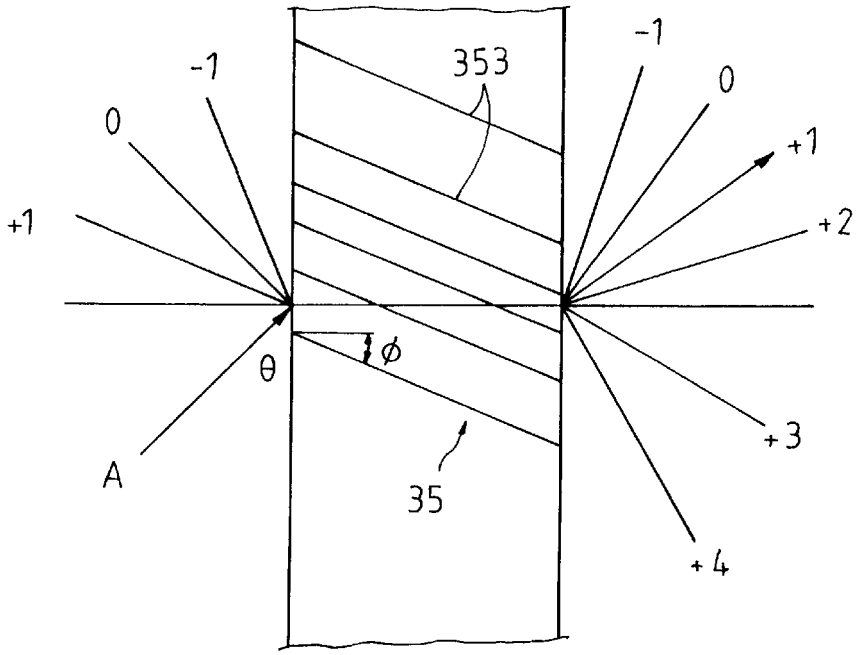
FIG. 4 illustrates the effect of the diffraction grating modulator of the first preferred embodiment on an incident electromagnetic wave.

Referring to FIG. 4, when Bragg conditions are satisfied, an electromagnetic wave (A) having an incident angle ($\phi$) will be diffracted by the slats 353 of the diffraction grating modulator 35 into the +1 order. As such, electromagnetic waves that are diffracted in a predetermined manner are thus obtained. When the antenna 3 is in a resonating condition, the interacting effect of the electric and magnetic fields due to electrical currents on the surface of the microstrip patch 32 results in the radiation of electromagnetic waves. By modulating the angles ($\phi$) of the slats 353 of the diffraction grating modulator 35, and by varying the periodic arrangement of the slats 353 of the diffraction grating modulator 35, electromagnetic waves can be modulated to improve the characteristics of the antenna 3.

Figure 1:
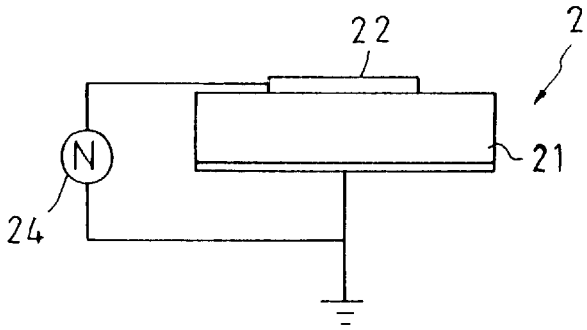
FIG. 1 PRIOR ART
FIG. 1 is a schematic side view of a conventional microstrip antenna.
Figure 2:
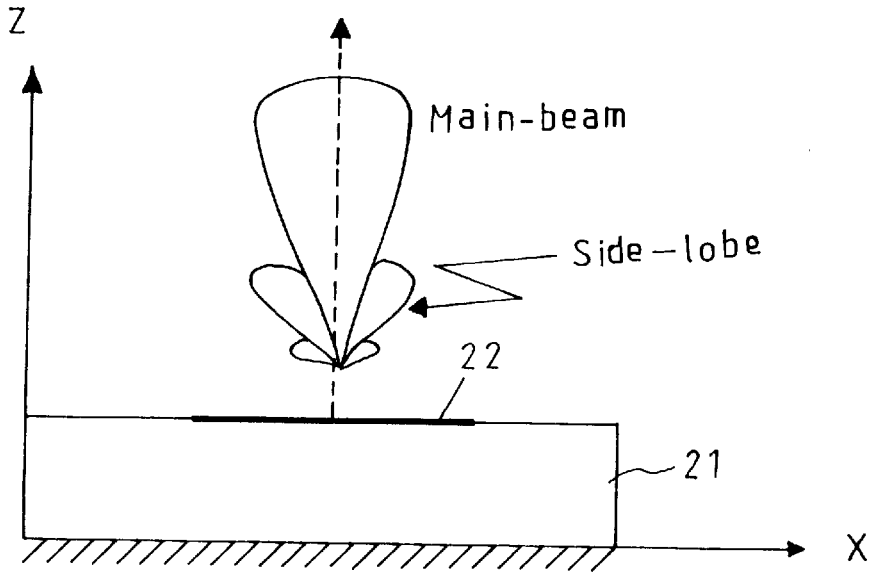
FIG. 2 PRIOR ART
FIG. 2 illustrates a radiation pattern of the conventional microstrip antenna of FIG. 1.
Figure 5:
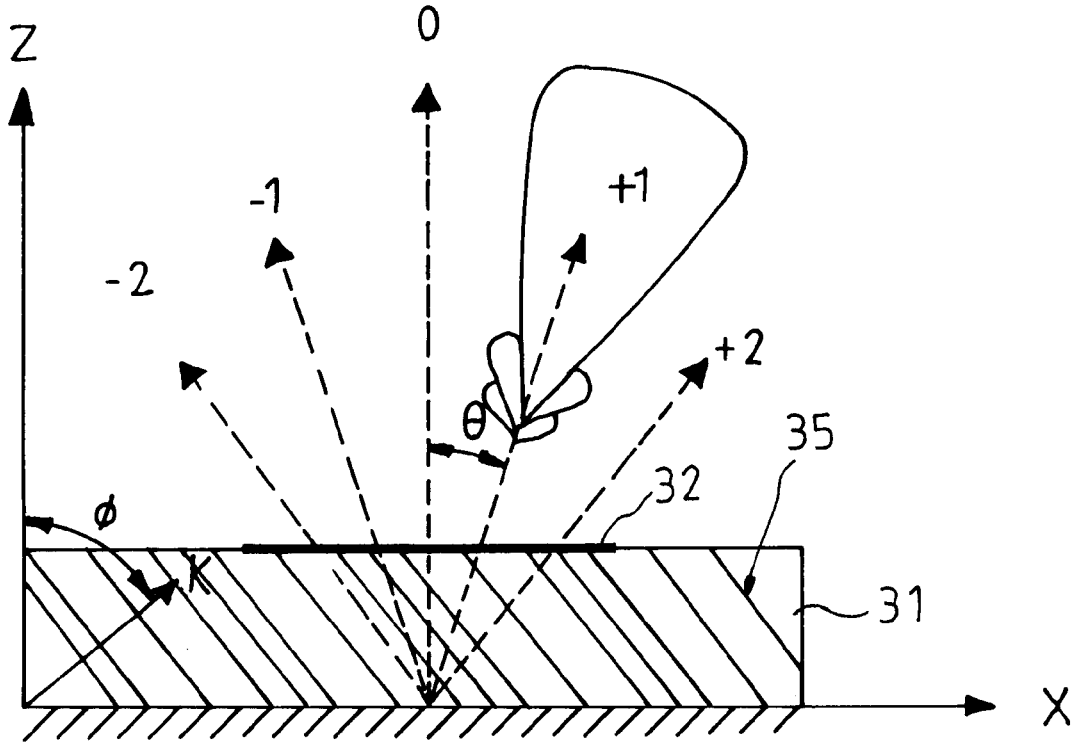
FIG. 5 illustrates a radiation pattern of the first preferred embodiment.

The radiation pattern of the antenna 3 is shown in FIG. 5. Note that with the use of the diffraction grating modulator 35, the diffracted main beam will make an angle ($\theta$) with the plane that is normal to the substrate, and the side lobe levels will be reduced as compared to the radiation pattern of FIG. 2.

Figure 6:
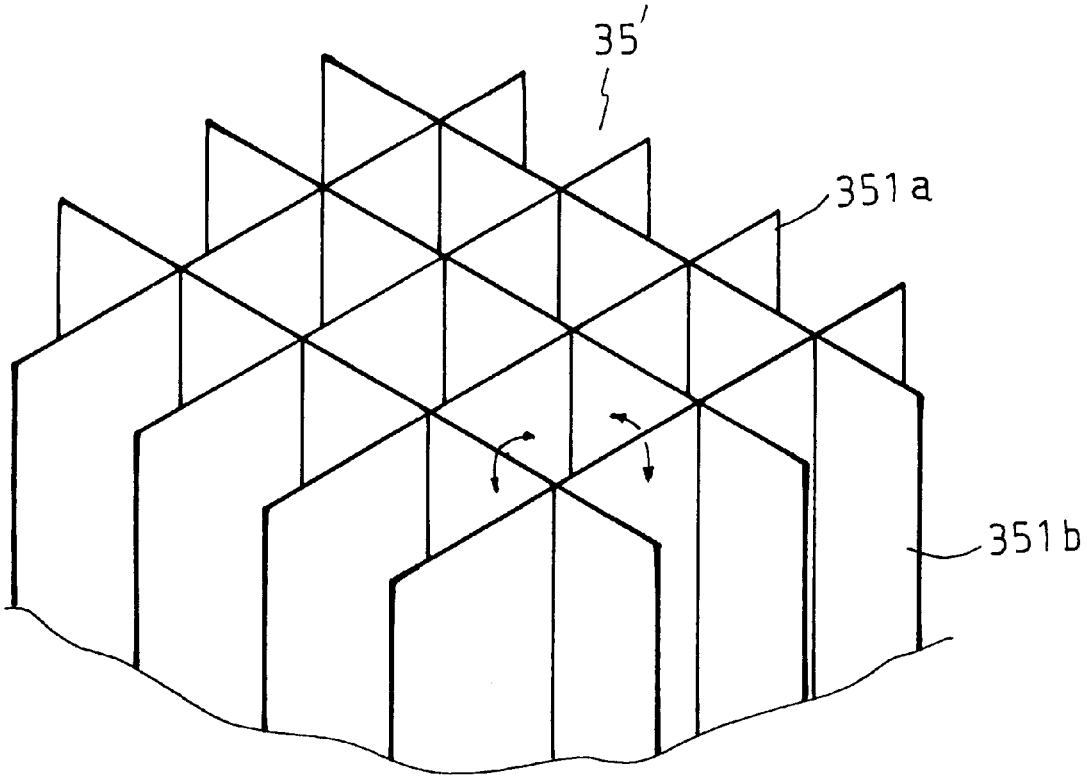
FIG. 6 is a fragmentary perspective view of a modified diffraction grating modulator for the antenna of this invention.

FIG. 6 illustrates a modified diffraction grating modulator 35' according to the present invention. Unlike the previous embodiment, in which the diffraction grating modulator 35 is a single grating modulator, the diffraction grating modulator 35' is a double grating modulator that includes first and second sets of parallel slats 351*a*, 351*b*. The slats 351*a*, 351*b* in each of the first and second sets are mounted along a control axle (not shown), and are spaced apart from each other at fixed intervals such that the slats 351*a*, 351*b* in one of the first and second sets intersect the slats 351*a*, 351*b* in the other one of the first and second sets. By operating the control axle, the angles that are formed by the slats 351*a*, 351*b* with a plane that is normal to the substrate can be adjusted.

Figure 7:
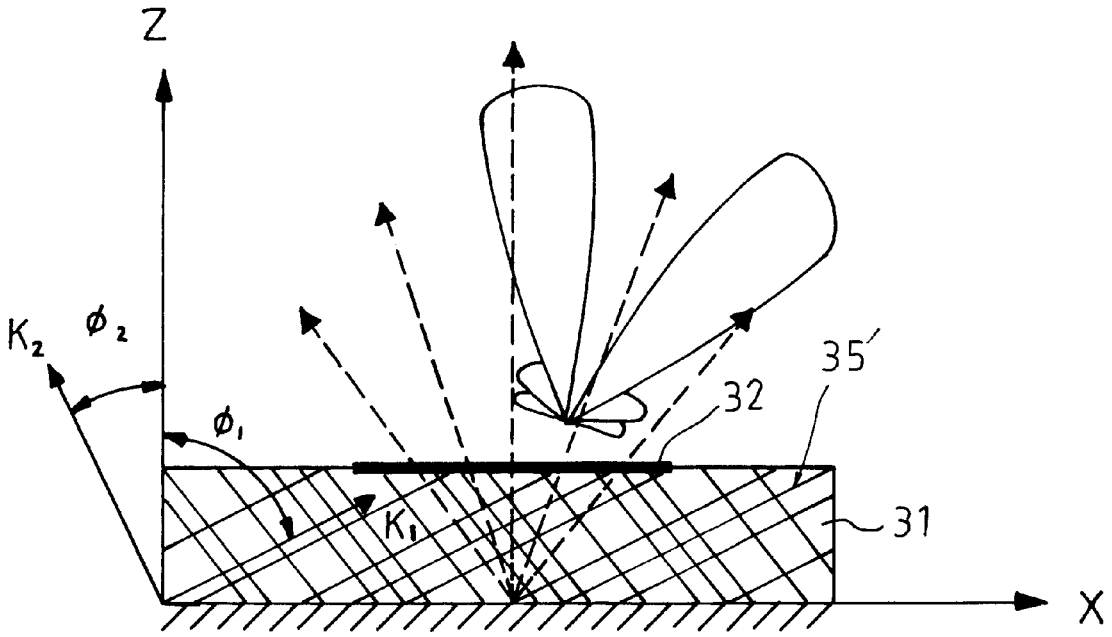
FIG. 7 is a radiation pattern of an antenna that incorporates the diffraction grating modulator of FIG. 6.

FIG. 7 illustrates the radiation pattern of an antenna that is provided with the diffraction grating modulator 35' of FIG. 6. The effect of the diffraction grating modulator 35' is to split the main beam into two. When Bragg conditions are satisfied, the radiation pattern is diffracted with respect to the plane that is normal to the substrate. This enables the antenna to receive and radiate signals at different angles and strengths.

Figure 8:
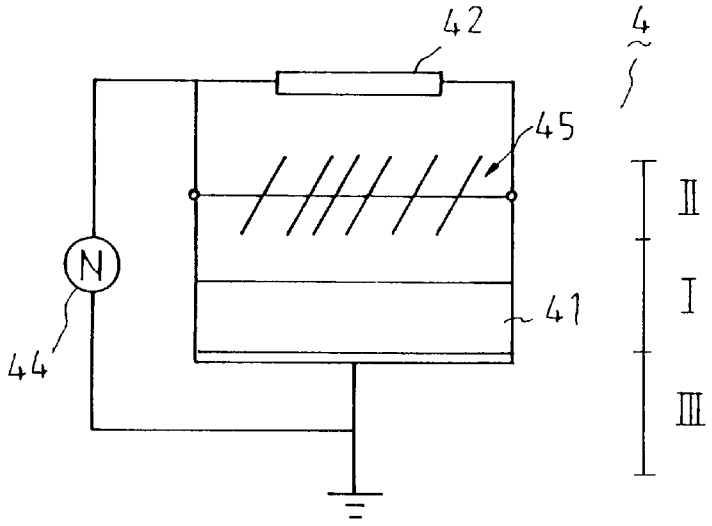
FIG. 8 is a schematic side view of the second preferred embodiment of an antenna according to the present invention.

FIG. 8 illustrates the second preferred embodiment of an antenna 4 according to the present invention. Unlike the embodiment of FIG. 3, the diffraction grating modulator 45 is disposed between the microstrip patch 42 and the substrate 41. The diffraction grating modulator 45 may be similar in construction to the diffraction grating modulator 35 of FIG. 3 or to the diffraction grating modulator 35' of FIG. 6.

Figure 9:
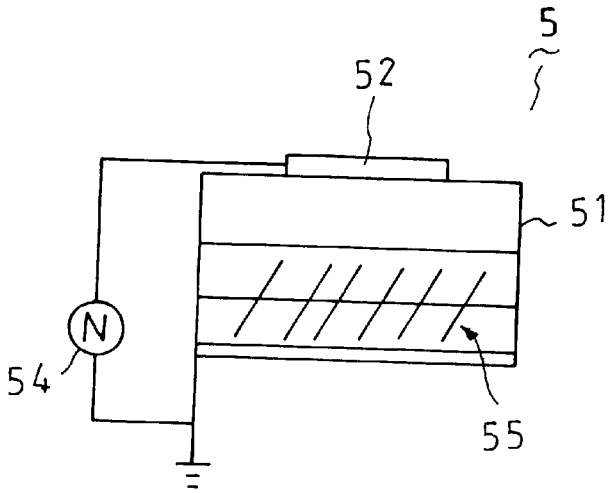
FIG. 9 is a schematic side view of the third preferred embodiment of an antenna according to the present invention.

FIG. 9 illustrates the third preferred embodiment of an antenna 5 according to the present invention. Unlike the embodiments of FIGS. 3 and 8, the diffraction grating modulator 55 is disposed below the substrate 51 and above the ground plane. The microstrip patch 52 is disposed on top of the substrate 51. The diffraction grating modulator 55 may be similar in construction to the diffraction grating modulator 35 of FIG. 3 or to the diffraction grating modulator 35' of FIG. 6.

The antenna operating frequency is important in the design and manufacture of an antenna. In each of the aforementioned embodiments, the antenna 3, 4, 5 can be divided into a first region I that is reserved for air gaps or other dielectric medium, a second region II that serves as a modulating region, and a third region III that serves as free space. It is noted that the arrangements of the first, second and third regions I, II, III differ in the aforementioned embodiments, thereby arising in different boundary conditions. However, such differences do not affect the determination of the operating frequency. In the present invention, the operating frequency is set to be the resonant frequency, and is determined as follows:

Under resonant conditions, the horizontal electric fields due to the electric currents $\vec{J}_x$ and $\vec{J}_y$ on the surface of the microstrip patch can be expressed as follows:

$$\vec{E}_x = \hat{x}\frac{1}{4\pi^2}\int_{-\infty}^{\infty}\int_{-\infty}^{\infty}(Q_{xx}F_x + Q_{xy}F_y)\exp(jk_x x + jk_y y)dk_x dy_y, \quad (1)$$

$$\vec{E}_y = \hat{y}\frac{1}{4\pi^2}\int_{-\infty}^{\infty}\int_{-\infty}^{\infty}(Q_{yx}F_x + Q_{yy}F_y)\exp(jk_x x + jk_y y)dk_x dy_y, \quad (2)$$

where $F_x$ and $F_y$ are Fourier transforms of $\vec{J}_x$ and $\vec{J}_y$; $Q_{xx}$, $Q_{xy}$, $Q_{yx}$, and $Q_{yy}$ are the Green's functions in a z=d system.

In the third region III, the electric and magnetic fields in the z direction can be expressed as follows:

$$E_{3z}(x, y, z) = \sum_i C_{iz}\exp\left[-j\vec{k}_{3i}\cdot\left(\vec{r}-\vec{d}\right)\right], \quad (3)$$

$$H_{3z}(x, y, z) = \sum_i D_{iz}\exp\left[-j\vec{k}_{3i}\cdot\left(\vec{r}-\vec{d}\right)\right], \quad (4)$$

where $C_{iz}$ and $D_{iz}$ are factors to be determined, and $$\vec{k}_{3i}=k_{3xim}\hat{x}+k_{3yin}\hat{y}+k_{3zi}\hat{z}, \quad (5)$$

The x and y components of $k_{3i}$ are determined according to the Floquet theorem. m and n are mode indices. i is the modulated index. The relationships among these terms are as follows:

$$k_{3i} = k = \frac{2\pi}{\lambda}, \quad (6)$$

$$k_{3xim}=k_{3xim}|_{i=0}-iK_z,$$

$$k_{3yin}=k_{3yin}|_{i=0},$$

$$k_{3zi} = (k^2 - k_{3xim}^2 - k_{3yin}^2)^{\frac{1}{2}},$$

i is a positive integer.

When Bragg conditions are satisfied, $$1\pi = k_{3xim}|_{i=0}K_x + (k^2\varepsilon_2 - k_{3xim}^2|_{i=0} - k_{3yin}^2)^{\frac{1}{2}}K_z, \quad (7)$$

where 1 is a positive integer.

The tangential components of the electric and magnetic fields can be obtained using Maxwell equations:

$$\nabla\times\vec{E}_3=-j\omega\mu_0\vec{H}_3, \quad (8)$$

$$\nabla\times\vec{H}_3=j\omega\epsilon_0\vec{E}_3, \quad (9)$$

where $\epsilon_0$ and $\mu_0$ are the permittivity and permeability constants in a vacuum. Accordingly, the tangential component of the i th mode electromagnetic wave can be expressed as follows:

$$(-j\omega\mu_0)H_{x3} + \frac{1}{j\omega\varepsilon_0}\frac{\partial^2 H_{x3}}{\partial z^2} = \frac{\partial E_{z3}}{\partial y} + \frac{1}{j\omega\varepsilon_0}\frac{\partial^2 H_{z3}}{\partial x\partial z}, \quad (10\text{-}1)$$

$$(-j\omega\mu_0)H_{y3} + \frac{1}{j\omega\varepsilon_0}\frac{\partial^2 H_{y3}}{\partial z^2} = -\frac{\partial E_{z3}}{\partial x} + \frac{1}{j\omega\varepsilon_0}\frac{\partial^2 H_{z3}}{\partial y\partial z}, \quad (10\text{-}2)$$

-continued $$j\omega\varepsilon_0 E_{x3} + \frac{1}{(-j\omega\mu_0)}\frac{\partial^2 E_{x3}}{\partial z^2} = \frac{\partial H_{z3}}{\partial y} + \frac{1}{(-j\omega\mu_0)}\frac{\partial^2 H_{z3}}{\partial x\partial z}, \quad (10\text{-}3)$$

$$j\omega\varepsilon_0 E_{x3} + \frac{1}{(-j\omega\mu_0)}\frac{\partial^2 E_{x3}}{\partial z^2} = \frac{\partial H_{z3}}{\partial y} + \frac{1}{(-j\omega\mu_0)}\frac{\partial^2 H_{z3}}{\partial x\partial z}, \quad (10\text{-}4)$$

The permittivity constant in the second region II is $$\epsilon(x,z)=\epsilon_2+\hat{\epsilon}\cos[K(x\sin\phi+z\cos\phi)], \quad (11)$$

Equation (11) can undergo Fourier expansion to result in $$\varepsilon(x, z) = \sum_{h=-1}^{1}\hat{\varepsilon}_h\exp\left(jh\vec{K}\cdot\vec{r}\right), \quad (12)$$

A non-linear result, which usually cannot be resolved, is obtained when wave equations are directly applied at this time. However, under the scope of the Floquet theorem, the electric and magnetic fields can be Fourier expanded, in terms of spatial harmonic field components, as follows:

$$\vec{E}_2(x, y, z) = \sum_i\left[S_{xi}(z)\hat{x} + S_{yi}(z)\hat{y} + S_{zi}(z)\hat{z}\right]\exp\left[-j\vec{\sigma}_i\cdot\vec{r}\right], \quad (13)$$

$$\vec{H}_2(x, y, z) = \left(\frac{\varepsilon_0}{\mu_0}\right)^{\frac{1}{2}}\sum_i\left[U_{xi}(z)\hat{x} + U_{yi}(z)\hat{y} + U_{zi}(z)\hat{z}\right]\exp\left[-j\vec{\sigma}_i\cdot\vec{r}\right], \quad (14)$$

where $$\vec{\sigma}_i=k_{xi}\hat{x}+k_y\hat{y}-iK_z\hat{z}, \quad (15)$$

By applying a curl operator to Equations (13) and (14), $$\nabla\times\vec{E}_2=-j\omega\mu_0\vec{H}_2, \quad (16)$$

$$\nabla\times\vec{H}_2=j\omega\epsilon_0\epsilon(x,z)\vec{E}_2, \quad (17)$$

Four first-order derivative wave equations are thus obtained:

$$\frac{dS_{xi}(z)}{dz} = -j\left\{iK_z S_{xi}(z) + \left(\frac{k_{xi}}{k}\right)\sum_p a_{i-p}[k_y U_{xp}(z) - k_{xp}U_{yp}(z)] + kU_{yi}(z)\right\}, \quad (18\text{-}1)$$

$$\frac{dS_{yi}(z)}{dz} = -j\left\{iK_z S_{yi}(z) - kU_{xi}(z) + \left(\frac{k_y}{k}\right)\sum_p a_{i-p}[k_y U_{xp}(z) - k_{xp}U_{yp}(z)]\right\}, \quad (18\text{-}2)$$

$$\frac{dU_{xi}(z)}{dz} = -j\left\{\left(\frac{k_{xi}}{k}\right)[k_y S_{xi}(z) - k_{xi}S_{yi}(z)] + k\sum_p \hat{\varepsilon}_{i-p}S_{yp}(z) - iK_z U_{xi}(z)\right\}, \quad (18\text{-}3)$$

$$\frac{dU_{yi}(z)}{dz} = -j\left\{k\sum_p \hat{\varepsilon}_{i-p}S_{xp}(z) - \left(\frac{k_y}{k}\right)[k_y S_{xi}(z) - k_{xi}S_{yi}(z)] + iK_z U_{yi}(z)\right\}, \quad (18\text{-}4)$$

where p=i−h, and $a_h$ is the hth Fourier expansion factor of $\epsilon^{-1}(x,z)$, $$\varepsilon^{-1}(x, z) = \sum_h a_h \exp\left[jh\vec{K}\cdot\vec{r}\right], \tag{19}$$

$$a_h = \frac{\left\{\left[\left(\frac{\varepsilon_2}{\hat{\varepsilon}}\right)^2 - 1\right]^{\frac{1}{2}} - \left(\frac{\varepsilon_2}{\hat{\varepsilon}}\right)\right\}^{|h|}}{\left(\varepsilon_2^2 - \hat{\varepsilon}^2\right)^{\frac{1}{2}}}, \tag{20}$$

By using state equations to express the solution table of the differential wave equations:

$$S_{xi}(z) = \sum_m c_m w_{1,im} \exp(\lambda_m z), \tag{21-1}$$

$$S_{yi}(z) = \sum_m c_m w_{2,im} \exp(\lambda_m z), \tag{21-2}$$

$$U_{xi}(z) = \sum_m c_m w_{3,im} \exp(\lambda_m z), \tag{21-3}$$

$$U_{yi}(z) = \sum_m c_m w_{4,im} \exp(\lambda_m z), \tag{21-4}$$

where $c_m$ is a factor to be determined, and $W_{n,im}$ (n=1,2,3,4) and $\lambda_m$ are eigenfunctions and eigenvalue of a feature array A (state variables of the wave equations), respectively.

If the Fourier transform pair is defined as follows:

$$\overline{E}(k_{xi}, k_y, z) = \int_{-\infty}^{\infty}\int_{-\infty}^{\infty} E(x, y, z)\exp(-jk_{xi}x - jk_y y)dx\,dy, \tag{22}$$

$$E(x, y, z) = \int_{-\infty}^{\infty}\int_{-\infty}^{\infty} \overline{E}(k_{xi}, k_y, z)\exp(-jk_{xi}x - jk_y y)dk_{xi}\,dk_y, \tag{23}$$

The i th mode horizontal field components $\overline{E}_{z3}$ and $\overline{H}_{z3}$ in the Fourier transform defined region (region III) can be expressed as follows:

$$\overline{E}_{3x}(z) = \frac{-\omega\mu_0 k_y}{k_{xi}^2 + k_y^2}\overline{H}_{3z}(z) - \frac{k_{xi}k_{3zi}}{k_{xi}^2 + k_y^2}\overline{E}_{3z}(z), \tag{24-1}$$

$$\overline{E}_{3y}(z) = \frac{\omega\mu_0 k_{xi}}{k_{xi}^2 + k_y^2}\overline{H}_{3z}(z) - \frac{k_y k_{3zi}}{k_{xi}^2 + k_y^2}\overline{E}_{3z}(z), \tag{24-2}$$

$$\overline{H}_{3x}(z) = \frac{\omega\varepsilon_0 k_y}{k_{xi}^2 + k_y^2}\overline{E}_{3z}(z) - \frac{k_{xi}k_{3zi}}{k_{xi}^2 + k_y^2}\overline{H}_{3z}(z), \tag{24-3}$$

$$\overline{H}_{3y}(z) = -\frac{\omega\varepsilon_0 k_{xi}}{k_{xi}^2 + k_y^2}\overline{E}_{3z}(z) - \frac{k_y k_{3zi}}{k_{xi}^2 + k_y^2}\overline{H}_{3z}(z), \tag{24-4}$$

In the second region II, the following can be obtained after performing Fourier transform on the horizontal electric and magnetic fields:

$$\overline{E}_{x2}(z) = \sum_i\sum_m c_m w_{1,im}\exp(\lambda_m z)\exp[j(iK_z z)], \tag{25-1}$$

$$\overline{E}_{y2}(z) = \sum_i\sum_m c_m w_{2,im}\exp(\lambda_m z)\exp[j(iK_z z)], \tag{25-2}$$

$$\overline{H}_{x2}(z) = \left(\frac{\varepsilon_0}{\mu_0}\right)^{\frac{1}{2}}\sum_i\sum_m c_m w_{3,im}\exp(\lambda_m z)\exp[j(iK_z z)], \tag{25-3}$$

-continued $$\overline{H}_{y2}(z) = \left(\frac{\varepsilon_0}{\mu_0}\right)^{\frac{1}{2}}\sum_i\sum_m c_m w_{4,im}\exp(\lambda_m z)\exp[j(iK_z z)], \tag{25-4}$$

Under continuous and non-continuous conditions for the tangential components of the electric and magnetic fields when z=0 and z=d, and $\overline{E}_{x2}(z=0)=0$, $\overline{E}_{y2}(z=0)=0$, we can obtain $$\overline{E}_{x2}(z) = \sum_i\sum_m c_m w_{1,im}\exp(\sigma'_m z)\sin[(\sigma''_m + iK_z)z], \tag{26-1}$$

$$\overline{E}_{y2}(z) = \sum_i\sum_m c_m w_{2,im}\exp(\sigma'_m z)\sin[(\sigma''_m + iK_z)z], \tag{26-2}$$

$$\overline{H}_{x2}(z) = \left(\frac{\varepsilon_0}{\mu_0}\right)^{\frac{1}{2}}\sum_i\sum_m c_m w_{3,im}\exp(\sigma'_m z)\cos[(\sigma''_m + iK_z)z], \tag{26-3}$$

$$\overline{H}_{y2}(z) = \left(\frac{\varepsilon_0}{\mu_0}\right)^{\frac{1}{2}}\sum_i\sum_m c_m w_{4,im}\exp(\sigma'_m z)\cos[(\sigma''_m + iK_z)z], \tag{26-4}$$

As such, the i th mode factors to be determined can be expressed as follows:

$$C_{iz} = \sum_m c_m a_m\left[-\frac{k_y}{k_{3zi}}w_{2,im} - \frac{k_{xi}}{k_{3zi}}w_{1,im}\right], \tag{27-1}$$

$$D_{iz} = \sum_m c_m a_m\left[\frac{k_{xi}}{\omega\mu_0}w_{2,im} - \frac{k_y}{\omega\mu_0}w_{1,im}\right], \tag{27-2}$$

where, $$a_m = \exp(\sigma'_m d)\sin[(\sigma''_m + iK_z)d], \tag{27-3}$$

$$b_m = \exp(\sigma'_m d)\cos[(\sigma''_m + iK_z)d], \tag{27-4}$$

$$\sigma'_m = \mathrm{Re}(\lambda_m), \tag{27-5}$$

$$\sigma''_m = \mathrm{Im}(\lambda_m), \tag{27-6}$$

The surface currents are $$J_{xi} = \sum_m c_m\left[\begin{array}{l}\frac{a_m}{k_{xi}^2 + k_y^2}\left(\frac{\omega\varepsilon_0 k_{xi}k_y}{k_{3zi}} - \frac{k_{xi}k_y k_{3zi}}{\omega\mu_0}\right)w_{2,im} \\ + \frac{a_m}{k_{xi}^2 + k_y^2}\left(\frac{k_y^2 k_{3zi}}{\omega\mu_0} + \frac{\omega\varepsilon_0 k_{xi}^2}{k_{3zi}}\right)w_{1,im} - \left(\frac{\varepsilon_0}{\mu_0}\right)^{\frac{1}{2}} b_m w_{4,im}\end{array}\right], \tag{28-1}$$

$$J_{yi} = \sum_m c_m\left[\begin{array}{l}\left(\frac{\varepsilon_0}{\mu_0}\right)^{\frac{1}{2}} w_{3,im} b_m + \frac{a_m}{k_{xi}^2 + k_y^2}\left(\frac{\omega\varepsilon_0 k_y^2}{k_{3zi}} + \frac{k_{xi}^2 k_{3zi}}{\omega\mu_0}\right)w_{2,im} \\ + \frac{a_m}{k_{xi}^2 + k_y^2}\left(\frac{\omega\varepsilon_0 k_{xi}k_y}{k_{3zi}} - \frac{k_{xi}k_y k_{3zi}}{\omega\mu_0}\right)w_{1,im}\end{array}\right], \tag{28-2}$$

Because $$\begin{bmatrix} E_{xi} \\ E_{yi} \end{bmatrix}_{m\times 1} = ([X])_{m\times m}[c_m]_{m\times 1}, \tag{29-1}$$

$$\begin{bmatrix} J_{xi} \\ J_{yi} \end{bmatrix}_{m\times 1} = ([Y])_{m\times m}[c_m]_{m\times 1}, \tag{29-2}$$

-continued $$([c_m])_{m\times 1}[Y]^{-1}_{m\times m}\begin{bmatrix} J_{xi} \\ J_{yi} \end{bmatrix}_{m\times 1}, \tag{29-3}$$

$$\begin{bmatrix} E_{xi} \\ E_{yi} \end{bmatrix}_{m\times 1} = [X]_{m\times m}[Y]^{-1}_{m\times m}\begin{bmatrix} J_{xi} \\ J_{yi} \end{bmatrix}_{m\times 1}, \tag{29-4}$$

The Green's function of the system can be expressed as follows:

$$[Q]_{mxm}=[X]_{mxm}[Y]_{mxm}^{-1}, \tag{30}$$

In the cavity mode analysis of a rectangular microstrip patch with dimensions a and b, using the eigenmodes as basis, the following equations can be obtained:

$$\vec{J}_{xm}(x, y) = \sin\left[\frac{p\pi}{a}\left(x+\frac{a}{2}\right)\right]\cos\left[\frac{q\pi}{b}\left(y+\frac{b}{2}\right)\right], \tag{31-1}$$

$$\vec{J}_{ym}(x, y) = \sin\left[\frac{s\pi}{b}\left(y+\frac{b}{2}\right)\right]\cos\left[\frac{r\pi}{a}\left(x+\frac{a}{2}\right)\right], \tag{31-2}$$

The Fourier transform of Equation (31) is $$\vec{F}(k_x, k_y) = \int_{-\frac{b}{2}}^{\frac{b}{2}}\int_{-\frac{a}{2}}^{\frac{a}{2}}\vec{J}(x, y)\exp(-jk_x x)\exp(-jk_y y)dx dy, \tag{32}$$

$$F_{yn} = j^{r+s}4s\pi\frac{k_x}{jb}\frac{\sin\left(\frac{r\pi}{2}-\frac{k_x a}{2}\right)}{k_x^2-\left(\frac{r\pi}{a}\right)^2}\frac{\sin\left(\frac{s\pi}{2}-\frac{k_y b}{2}\right)}{k_y^2-\left(\frac{s\pi}{b}\right)^2}, \tag{32-1}$$

$$F_{xn} = j^{p+q}4p\pi\frac{k_y}{ja}\frac{\sin\left(\frac{p\pi}{2}-\frac{k_x a}{2}\right)}{k_x^2-\left(\frac{p\pi}{a}\right)^2}\frac{\sin\left(\frac{q\pi}{2}-\frac{k_y b}{2}\right)}{k_y^2-\left(\frac{q\pi}{b}\right)^2}, \tag{32-2}$$

By processing the resonance problem Equations (1), (2) under no external source to obtain process integration equations:

$$\int_{-\infty}^{\infty}\int_{-\infty}^{\infty}(Q_{xx}F_x + Q_{xy}F_y)\exp(jk_x x + jk_y y)dk_x dk_y = 0, \tag{33-1}$$

$$\int_{-\infty}^{\infty}\int_{-\infty}^{\infty}(Q_{yx}F_x + Q_{yy}F_y)\exp(jk_x x + jk_y y)dk_x dk_y = 0, \tag{33-2}$$

where $$F_y = \sum_{m=1}^{N} I_{my}F_{ym}(k_x, k_y), \tag{33-3}$$

$$F_x = \sum_{n=1}^{M} I_{nx}F_{xn}(k_x, k_y), \tag{33-4}$$

When expressed in matrix form, $$\begin{bmatrix} (Z_{kn}^{xx})_{N*N} & (Z_{km}^{xy})_{N*M} \\ (Z_{ln}^{yx})_{M*N} & (Z_{lm}^{yy})_{M*M} \end{bmatrix}\begin{bmatrix} (I_{xn})_{N*1} \\ (I_{ym})_{M+1} \end{bmatrix} = \begin{bmatrix} 0 \\ 0 \end{bmatrix}, \tag{34}$$

wherein $$Z_{kn}^{xx} = \int_{-\infty}^{\infty}\int_{-\infty}^{\infty}F_{xk}(-k_x, -k_y)Q_{xx}F_{xn}(k_x, k_y)dk_x dk_y, \tag{34-1}$$

$$Z_{km}^{xy} = \int_{-\infty}^{\infty}\int_{-\infty}^{\infty}F_{xk}(-k_x, -k_y)Q_{xy}F_{ym}(k_x, k_y)dk_x dk_y, \tag{34-2}$$

$$Z_{ln}^{yx} = \int_{-\infty}^{\infty}\int_{-\infty}^{\infty}F_{yl}(-k_x, -k_y)Q_{yx}F_{xn}(k_x, k_y)dk_x dk_y, \tag{34-3}$$

$$Z_{lm}^{yy} = \int_{-\infty}^{\infty}\int_{-\infty}^{\infty}F_{yl}(-k_x, -k_y)Q_{yy}F_{ym}(k_x, k_y)dk_x dk_y, \tag{34-4}$$

$k, n = 1, 2, \ldots N, l, m = 1, 2, \ldots M.$

In order for the amplitude [I] to be determined in Equation (34) to have a non-zero solution, $$\det[z]=0, \tag{35}$$

Equation (35) results in a plurality of frequencies f=f'+jf", wherein f' is the system resonant frequency.

Figure 10:
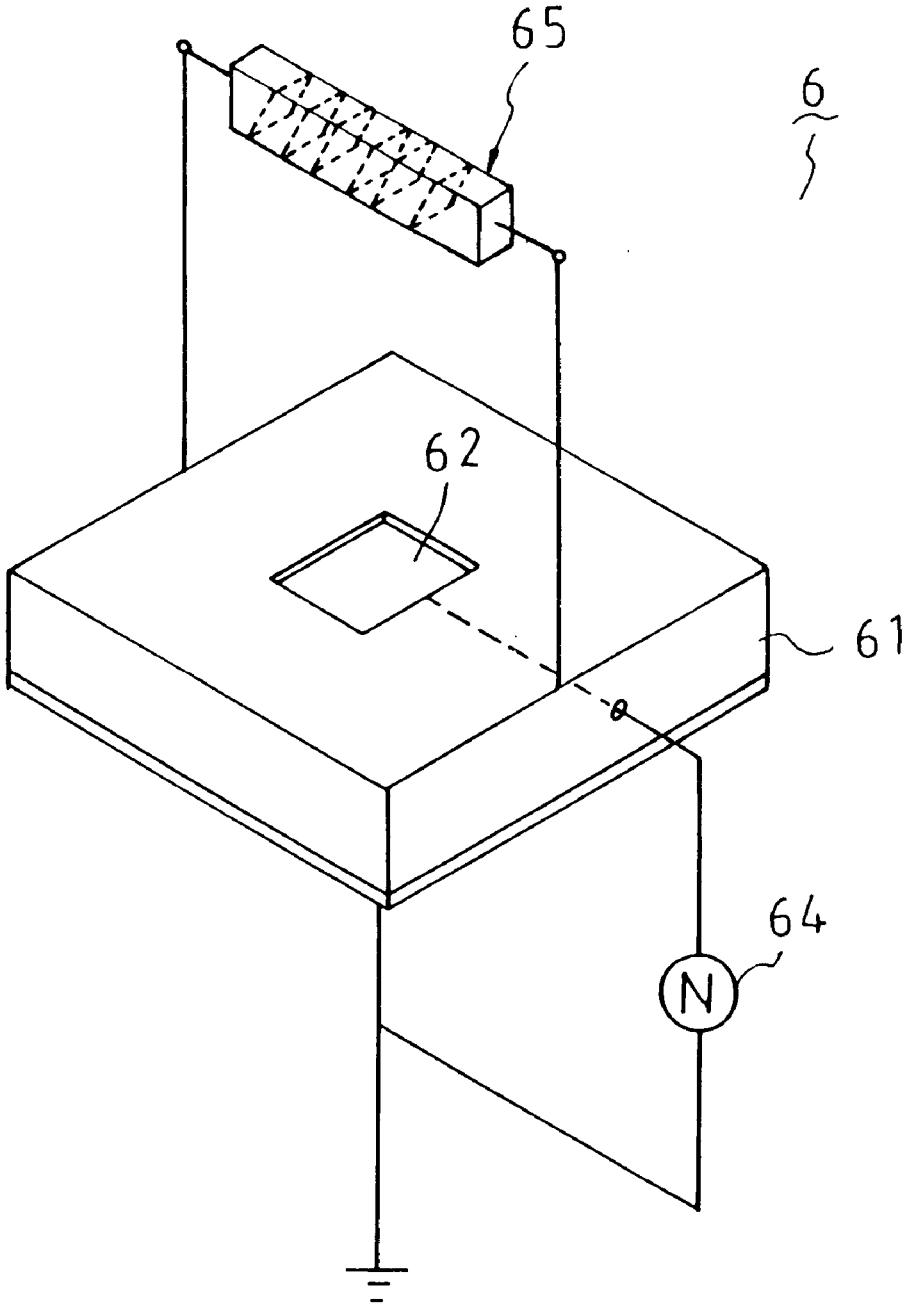
FIG. 10 is a schematic side view of the fourth preferred embodiment of an antenna according to the present invention.

FIG. 10 illustrates still another preferred embodiment of an antenna 6 according to the present invention. As illustrated, the antenna 6 is in the form of a slot antenna that includes a substrate 61, a slot 62 adapted to be formed in a ground plane, and a microstrip feed line 64 adapted to be connected to the ground plane. A diffraction grating modulator 65 may be provided above or below the substrate 61. In this embodiment, the diffraction grating modulator 65 is disposed above the slot 62 and the substrate 61. The diffraction grating modulator 65 may be similar in construction to the diffraction grating modulator 35 of FIG. 3 or to the diffraction grating modulator 35' of FIG. 6. The function and effect of the diffraction grating modulator 65 are similar to those of the modulators described in the foregoing embodiments and will not be detailed further.

The advantages of the antenna of this invention are as follows:

1. Because of the spatial periodic structure of the diffraction grating modulator, a reduction in the side lobe levels can be attained when Bragg conditions are satisfied, thereby resulting in a higher antenna gain. In addition, when the diffraction grating modulator is a double grating modulator, the bandwidth of the antenna can be increased.

2. By adjusting the periodic permittivity or the periodic arrangement of the diffraction grating modulator, the resonance frequency of the antenna can be increased. If a ceramic material is used as the substrate of the antenna of this invention, the operating frequency can be increased to more than 100 GHz, while permitting a substantial reduction in the size of the antenna.

3. Due to the inherent filtering characteristics of the diffraction grating modulator, by controlling the phase and periodic arrangement of the diffraction grating modulator, external electromagnetic interference of a communications system with another system or component can be effectively prevented.

4. When the diffraction grating modulator is a double grating modulator, electromagnetic waves can be split into two beams of different energy density and directions, thereby permitting radiation and reception of signals to and from different angles to broaden the service range of the antenna.

5. The diffraction grating modulator can be viewed as a component that is separate from the substrate and that can be removed or replaced as desired to vary the antenna resonance conditions and to permit operation of the antenna at different operating frequencies, thereby enhancing flexibility of the antenna and permitting modular design of the antenna.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An antenna comprising a substrate adapted to be disposed on a ground plane and made of a dielectric material, a microstrip patch disposed on top of said substrate, a signal feed line having a first end connected to said microstrip patch and a second end adapted to be connected to the ground plane, and an adjustable slatted diffraction grating modulator mounted on said substrate and formed with a spatial periodic permittivity adjustable structure, said microstrip patch radiating and receiving electromagnetic waves when a signal between said substrate and said microstrip patch and passing through said signal feed line satisfies Bragg condition structural resonance conditions, said diffraction grating modulator diffracting the electromagnetic waves in a predetermined manner.

2. The antenna as claimed in claim 1, wherein said diffraction grating modulator is disposed above said microstrip patch.

3. The antenna as claimed in claim 1, wherein said diffraction grating modulator is disposed between said microstrip patch and said substrate.

4. The antenna as claimed in claim 1, wherein said diffraction grating modulator is disposed between said substrate and the ground plane.

5. The antenna as claimed in claim 1, wherein said diffraction grating modulator includes:

a spaced pair of parallel props having first ends mounted on said substrate, and opposite second ends;

a control axle extending between and mounted rotatably on said second ends of said props; and a plurality of parallel slats mounted along said control axle and spaced apart from each other at fixed intervals to provide said diffraction grating modulator with the spatial periodic permittivity adjustable structure.

6. The antenna as claimed in claim 5, wherein said slats form an adjustable angle with a plane normal to said substrate.

7. The antenna as claimed in claim 1, wherein said diffraction grating modulator includes a control axle, and first and second sets of parallel slats, said slats in each of said first and second sets being mounted along said control axle and being spaced apart from each other at fixed intervals such that said slats in one of said first and second sets intersect said slats in the other one of said first and second sets.

8. The antenna as claimed in claim 7, wherein said slats in each of said first and second sets form adjustable angles with a plane normal to said substrate.

9. The antenna as claimed in claim 1, wherein said diffraction grating modulator is a single grating modulator.

10. The antenna as claimed in claim 1, wherein said diffraction grating modulator is a double grating modulator for splitting the electromagnetic waves into beams of different energy densities and different directions.

11. An antenna comprising a substrate, a slot adapted to be formed in a ground plane, a microstrip feed line adapted to be connected to the ground plane, and an adjustable slatted diffraction grating modulator mounted on said substrate and formed with a spatial periodic permittivity adjustable structure, said slot radiating and receiving electromagnetic waves when a signal between said substrate and said slot satisfies Bragg condition structural resonance conditions, said diffraction grating modulator diffracting the electromagnetic waves in a predetermined manner.

12. The antenna as claimed in claim 11, wherein said diffraction grating modulator is disposed above said substrate.

13. The antenna as claimed in claim 11, wherein said diffraction grating modulator is disposed below said substrate.

14. The antenna as claimed in claim 11, wherein said diffraction grating modulator includes:

a spaced pair of parallel props having first ends mounted on said substrate, and opposite second ends;

a control axle extending between and mounted rotatably on said second ends of said props; and a plurality of parallel slats mounted along said control axle and spaced apart from each other at fixed intervals to provide said diffraction grating modulator with the spatial periodic permittivity adjustable structure.

15. The antenna as claimed in claim 14, wherein said slats form an adjustable angle with a plane normal to said substrate.

16. The antenna as claimed in claim 11, wherein said diffraction grating modulator includes a control axle, and first and second sets of parallel slats, said slats in each of said first and second sets being mounted along said control axle and being spaced apart from each other at fixed intervals such that said slats in one of said first and second sets intersect said slats in the other one of said first and second sets.

17. The antenna as claimed in claim 16, wherein said slats in each of said first and second sets form adjustable angles with a plane normal to said substrate.

18. The antenna as claimed in claim 11, wherein said diffraction grating modulator is a single grating modulator.

19. The antenna as claimed in claim 11, wherein said diffraction grating modulator is a double grating modulator for splitting the electromagnetic waves into beams of different energy densities and different directions.

* * * * *

UNITED STATES PATENT AND TRADEMARK OFFICE

CERTIFICATE OF CORRECTION

PATENT NO. : 6,037,904
DATED : March 14, 2000
INVENTOR(S) : Cheng et al.

It is certified that error appears in the above-identified patent and that said Letters Patent is hereby corrected as shown below:

Column 5,
Line 1, "d $k_x$d $y_y$" should read -- $dk_x dk_y$ --
Line 5, "d $k_x$d $y_y$" should read -- $dk_x dk_y$ --

Signed and Sealed this

Tenth Day of December, 2002

JAMES E. ROGAN
*Director of the United States Patent and Trademark Office*